US008561794B2

(12) United States Patent
Mize

(10) Patent No.: US 8,561,794 B2
(45) Date of Patent: Oct. 22, 2013

(54) DEVICE FOR SECURING A JUNIOR GOLF BAG TO A GOLF CART AND METHODS OF USE THEREOF

(76) Inventor: Fredy Mize, Plano, TX (US)

( * ) Notice: Subject to any disclaimer, the term of this patent is extended or adjusted under 35 U.S.C. 154(b) by 184 days.

(21) Appl. No.: 13/190,302

(22) Filed: Jul. 25, 2011

(65) Prior Publication Data

US 2012/0018321 A1 Jan. 26, 2012

Related U.S. Application Data

(60) Provisional application No. 61/367,027, filed on Jul. 23, 2010.

(51) Int. Cl.
*B62J 7/00* (2006.01)

(52) U.S. Cl.
USPC ..... 206/315.3; 206/315.1; 206/315.2; 206/315.5; 206/315.6; 206/315.7; 206/316; 211/70.2; 224/274

(58) Field of Classification Search
USPC ..... 206/315.1, 315.2, 315.7, 315.9; 211/70.2; 224/183, 191, 223, 269, 274
See application file for complete search history.

(56) References Cited

U.S. PATENT DOCUMENTS

| | | | | | |
|---|---|---|---|---|---|
| 3,265,106 | A * | 8/1966 | Jarman | 206/315.6 |
| 5,127,530 | A * | 7/1992 | Ortuno | 211/70.2 |
| 5,425,452 | A * | 6/1995 | Shanks et al. | 206/315.7 |
| 5,439,135 | A * | 8/1995 | Schrader et al. | 221/251 |
| 5,573,122 | A * | 11/1996 | Williams | 211/70.2 |
| 5,671,842 | A * | 9/1997 | Jaworski | 206/315.3 |
| 5,816,396 | A * | 10/1998 | Shin | 206/315.3 |
| 6,640,970 | B1 * | 11/2003 | Townsend, Jr. | 206/315.2 |
| 7,059,470 | B2 * | 6/2006 | Slankster | 206/315.3 |
| 7,549,534 | B1 * | 6/2009 | Parpart | 206/315.7 |
| 7,631,755 | B1 * | 12/2009 | Sanders | 206/315.7 |

* cited by examiner

*Primary Examiner* — Anthony Stashick
*Assistant Examiner* — Cynthia Collado
(74) *Attorney, Agent, or Firm* — Greenberg Traurig, LLP; Ross Spencer Garsson

(57) ABSTRACT

Devices for securing a junior golf bag to a golf cart and methods of use thereof are shown. A golf bag insert device and a tilted golf bag securing device each provide junior golfers to have better access to their clubs (both visually and physically) without worries of their clubs or bag becoming dislodged from the cart.

13 Claims, 14 Drawing Sheets

DEVICE FOR SECURING A JUNIOR GOLF BAG TO A GOLF CART AND METHODS OF USE THEREOF

CROSS-REFERENCE TO RELATED PATENT APPLICATIONS

This application claims priority to: provisional U.S. Patent Application Ser. No. 61/367,027, filed on Jul. 23, 2010, entitled "Devices For Securing A Junior Golf Bag To A Golf Cart And Methods of Use Thereof," which provisional patent application is commonly assigned to the Assignee of the present invention and is hereby incorporated herein by reference in its entirety for all purposes.

BACKGROUND

1. Field of Invention

The present invention relates to devices for securing a junior golf bag to a golf cart and methods of use thereof. A golf bag insert device and a tilted golf bag securing device each provide junior golfers to have better access to their clubs (both visually and physically) without worries of their clubs or bag becoming dislodged from the cart.

2. Background of the Invention

FIG. 1 shows how an adult golf bag 101 is attached to a golf cart 102 in the rear portion 103. The golf bag 101 stands on a back area 104 and then attached to the golf cart 102, such as by strap 105 and buckle 106. Features (like golf bag holder 107) are positioned on the golf cart 102 to facilitate attaching the golf bag 101 to the golf cart 102.

However, golf carts are generally designed for adult golfers. As illustrated in FIG. 2, a junior golfer (such as junior golfer 201) is shorter than adult golfers, and use shorter clubs and a shorter bags (such as junior golf bag 202).

As shown in FIG. 3, a major problem that all junior golfers (such as junior golfer 201) have today is the ability to attach their junior golf bag 202 to the golf cart 102 and still have them accessible to their reach. When using the attaching the junior golf bag 202 using the strap 105 and buckle 106, the junior golf bag 202 is unstable (as it is not resting on the back area 104 of the rear portion 103 of the golf cart 102. Moreover, in today's world, it is almost impossible for a junior golfer 201 to be able see their clubs in their junior golf bag 202 (once attached to the golf cart 102) to make a selection much less remove the club from the bag.

This makes the need for the assistance of an adult a must on every shot. Accordingly, there is a need for an improved attachment so that junior golfers can have visual view the clubs in the bag, select which club the junior golfer desires, and then removing the club from the bag without assistance. Moreover, there is a need for an improved attachment to better stabilize the junior golf bag when attached to the golf cart.

SUMMARY OF THE INVENTION

The present invention relates to devices for securing a junior golf bag to a golf cart and methods of use thereof.

In general, in one aspect, the invention features a golf bag insert device that includes an inner pipe. The inner pipe has a first inner pipe end and a second inner pipe end. The golf bag insert device further includes an outer pipe slidably connected to the inner pipe. The outer pipe has a first outer pipe end and a second outer pipe end. The first inner pipe end is positioned within the first outer pipe end. The second inner pipe end is at a first end of the golf bag insert device. The second outer pipe end is at a second end of the golf bag insert. The inner pipe is operable to slide within the outer pipe such that the length of the golf insert device is variable. The golf bag insert device further includes a spring locating within the outer pipe operably in contact with the first end of the inner pipe. The spring is operable for maintaining tension between the outer pipe and the inner pipe. The golf bag insert device further includes a connector. The golf bag insert device further includes a first pipe cap. One of the connector and the first pipe cap is connected at or near the first end of the golf bag insert device. The other of the connector and the first pipe cap is connected at or near the second end of the golf bag insert device. The first pipe cap is operable for insertion into a golf bag and resting at the base of the golf bag without substantial damage to the golf bag. The length of the golf bag insert device is operably variable to maintain the connector outside the golf bag when the first pipe cap is resting at the base of the golf bag while the spring maintains tension between the outer pipe and the inner pipe. The golf bag is a junior golf bag. The connector is operably connectable to a portion of a golf cart to secure the junior golf bag to the golf cart at a level wherein a junior golfer can view golf clubs within the junior golf bag, remove clubs from the junior golf bag, and place clubs into the junior golf bag.

Implementations of the invention can include one or more of the following features:

One or both of the outer pipe and inner pipe may include metal.

The golf bag insert device may further include a fastener located on one or both of the outer pipe and the inner pipe operable for fastening the outer pipe and inner pipe together while tension is applied by the spring.

The fastener is may be a nut and bolt, a tab, a rotatable tightener, or a combination thereof.

The fastener may be a spring loaded tab.

The connector may include a hook.

The golf bag insert device may be in the form of a golf club.

The golf bag insert device may further include a second end cap. The second end cap may be connected at the end of the golf club insert near the connector.

The second end cap may be in the shape of a golf club head.

The second end cap may include a golf club head.

The inner pipe may be in the form of a golf club shaft. The outer pipe may include a first portion that is in the form of a golf club grip. The spring may be located within the first portion of the outer pipe. The connector may be connected near the second inner pipe end. The second end cap may be connected at the second inner pipe end. The second end cap may be in the form of a golf club head. The golf club insert device may be in the form of a golf club.

The inner pipe may be a portion of a golf club shaft. A golf club head may be attached to the inner pipe. The outer pipe may be a portion of a golf club shaft that includes the golf club grip. The spring may be located within the golf club grip. The connector may be connected near the golf club head.

The golf bag insert device may be operable for moving the inner pipe and the outer pipe end relative to one another and maintaining the golf bag insert device at variable lengths. The golf insert device may be operable for being maintained at a length short enough to be stored within the junior golf club bag in the same manner as junior golf clubs are stored within the junior golf club bag.

In general, in another aspect, the invention features a method of connecting a junior golf club bag to a golf cart. The method includes selecting a golf bag insert device that has a variable length. The method further includes placing the golf bag insert inside a junior club bag. One end of the golf bag insert device is positioned inside and at the base of the junior golf bag. The other end of the golf bag insert is positioned at the top and outside the junior golf bag. The method further includes placing the junior golf bag in a golf cart. The junior golf bag is positioned at a level such that golf clubs inside the junior golf bag are at a level wherein a junior golfer can view golf clubs within the junior golf bag, can remove clubs from the junior golf bag, and can place clubs into the junior golf bag. The method further includes securing the golf bag insert device to a golf cart to secure the junior golf bag to the cart.

Implementations of the invention can include one or more of the following features:

The method of placing the golf bag insert device inside the junior club bag may include varying the length of the golf bag insert device to a length that long enough for one end of the golf bag insert device to positioned inside and at the base of the junior golf bag and the other end of the golf bag insert to be positioned at the top and outside the junior golf bag.

The golf bag insert device may be in the form of a golf club.

The method may further include storing the golf club insert device inside the junior golf bag.

The method may further include adjusting the length of the golf bag insert device such that it can be stored within the junior golf bag.

The length of the golf bag insert device may be adjusted such that it is substantially the same or shorter than the longest golf club in the junior golf club bag.

The method may further include transporting the golf bag insert device to a golf course inside the junior golf club bag.

The method may further include fastening the outer pipe and the inner pipe together before securing the golf bag insert device to a golf cart to secure the junior golf bag to the cart.

In general, in another aspect, the invention features a tilted golf bag securing device that includes a curved material. The curved material includes a base, a top, an outer wall surface, and an inner wall surface. The base is operable for standing inside a golf bag receptacle of a golf cart with the top of the curve metal tilted at an angle. The inner wall surface is shaped to receive a golf bag such that the substantial portions of the back and sides of the bottom section of the golf bag golf bag can rest on the inner wall surface tilted at the angle. The tilted golf bag securing device further includes a fastener operable for fastening the tilted golf bag securing device to the golf cart when the golf bag is resting on the inner wall surface at the angle. The angle of the golf bag is operable for positioning the golf bag in a manner to facilitate viewing, selecting, removing, and placing golf clubs within the golf bag.

Implementations of the invention can include one or more of the following features:

The tilted golf bag securing device may further include an extended base operatively connected to the base of the curved material. The extended base may have a bottom that is substantially flat. The extended base may be connected to the base of the curved material such that when the bottom of the extended base is substantially level, the inner wall surface of the curved material is tilted at the angle. The extended base may be operable for resting in a substantially level position within the golf bag receptacle of a golf cart.

The extended base may have a top substantially perpendicular to the inner wall surface of the curved material such that when the golf bag rests on the inner wall surface tilted at the angle, the base of the golf bag is substantially flat on the top of the extended base.

The curved material may include a metal.

The curved material may include a seamless sheet of metal.

The tilted golf bag securing device may further include a strap operable for securing the golf bag within the tilted golf bag securing device.

The strap may have a strap fastener operable for fastening the strap when used to secure the golf bag within the tilted golf bag securing device.

The strap fastener can be a hook, a hook and look material, a snap, a belt fastener, and a combination thereof.

The golf bag may be a junior golf bag.

In general, in another aspect, the invention features a method of securing a golf bag to a golf cart at a tilted angle. The method includes selecting a tilted golf bag securing device having a curved material with an inner wall surface. The method further includes placing the tilted golf bag securing device in a golf bag receptacle of a golf cart. The method further includes placing a golf bag in the tilted golf bag securing device such that substantial portions of the back and sides of the bottom section of the golf bag golf bag are resting on the inner wall surface tilted at an angle. The angle of the golf bag positions the golf bag in a manner to facilitate viewing, selecting, removing, and placing golf clubs within the golf bag. The method further includes securing the tilted golf bag securing device to the golf cart.

Implementations of the invention can include one or more of the following features:

The method may further include securing the golf bag within the tilted golf bag securing device.

The step of securing the golf bag within the tilted golf bag securing device may include strapping the golf bag within the tilted golf bag securing device.

The tilted golf bag securing device may include an extended base having a substantially flat bottom. The step of placing the tilted golf bag securing device in a golf bag receptacle may include placing the extended base such that the substantially flat bottom is substantially horizontal to the golf bag receptacle of the golf cart.

The extended base may have a top surface that is substantially perpendicular to the inner wall surface of the curve material. The step of placing the tilted golf bag securing device in a golf bag receptacle of a golf cart may include positioning the base of the golf bag substantially flat on the top of extended base.

The step of securing the tilted golf bag securing device to the golf cart may include strapping the tilted golf bag securing device to the golf cart.

The golf bag may be a junior golf bag.

DESCRIPTION OF THE INVENTION

The present invention relates to devices for securing a junior golf bag to a golf cart and methods of use thereof. Applicant has created a golf bag insert and a tilted golf bag securing device that each provide for junior golfers to have better access to their clubs (both visually and physically) without worries of their clubs or bag becoming dislodged from the cart. The golf bag insert and the tilted golf bag securing device can also be used by adult golfers who wish better access to their clubs.

Golf Bag Insert Device

In certain embodiments of the present invention, the junior golfer's bag is attached to the cart (using the standard attachment designed for an adult golfer's bag) at a height that fits the junior golfer's line of sight and reach.

Figure 4:
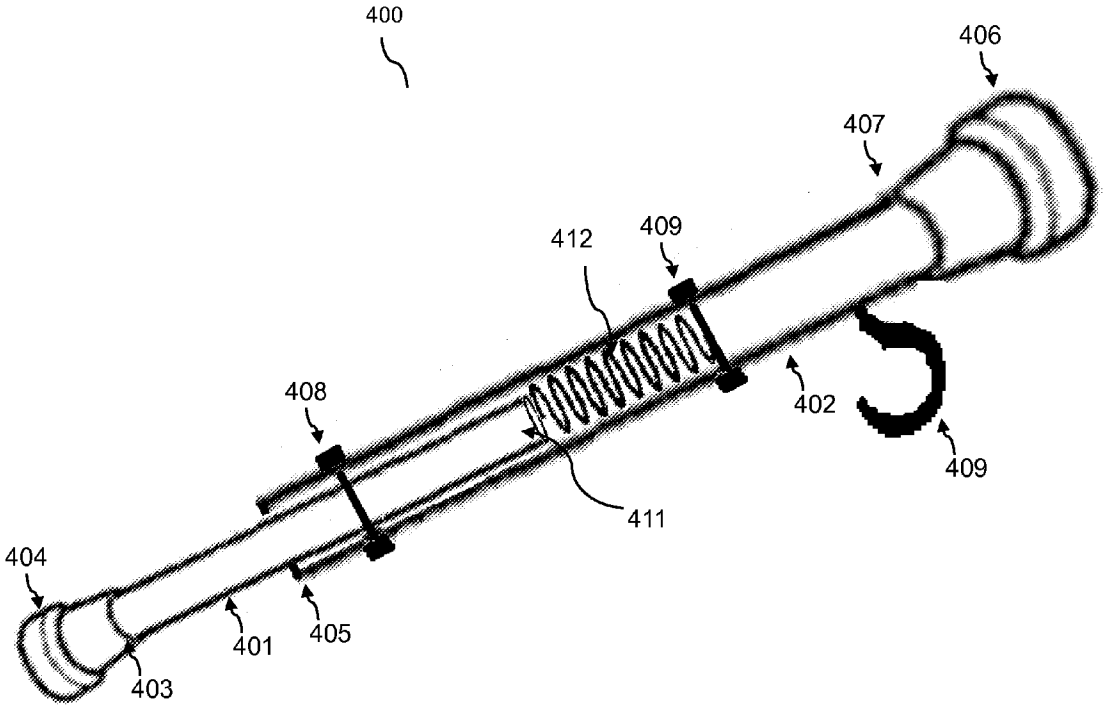
FIG. 4 is an illustration of a golf bag insert device of the present invention.

FIG. 4 shows an embodiment of present invention, which is a golf bag insert device 400 that can be used to secure a junior golfer's golf bag to a golf cart using the standard attachment designed for an adult golfer's bag. As standard attachment designed for an adult golfer's bag are used on most present day golf carts, the golf bag inert 400 can be readily used with most golf carts.

Golf bag insert device 400 includes an inner pipe 401 and an outer pipe 402. These pipes can be made from metal or other material (like PVC, plastic, etc.) For orientation purposes, the inner pipe 401 has two ends, a first inner pipe end 411 and a second inner pipe end 403. The outer pipe 402 has two ends, a first outer pipe end 405 and a second outer pipe end 407. The outer diameter of the inner pipe 401 is smaller than the inner diameter of the outer pipe 402, such that the first inner pipe end 411 can be inserted into the first outer pipe end 405, as shown in FIG. 4. In some embodiments, the inner pipe 401 and outer pipe 402 are tapered. In such instance, the portion of inner pipe 401 near first inner pipe end 411 has an outer diameter that is smaller than the inner diameter of the portion of outer pipe 402 near first outer pipe end 405 such that this portion of inner pipe 402 can be positioned inside this portion of the outer pipe 402.

When inserted, the first inner pipe end 411 is inside the second pipe 402, and the second inner pipe end 403 is outside the second pipe 402 Optionally, a inner pipe cap 404 (such as a rubber cap) can be placed on second inner pipe end 403. The inner pipe cap 404 provides protection such that when the golf bag insert 400 is placed inside a golf bag, it will protect the interior of the bag from tear. It is also provides safety when handling the golf bag insert.

A spring 412 is positioned inside the outer pipe 402 such that tension is applied by the spring 412 to the first inner pipe end 411. Spring 412 is secured within the outer pipe 402 such as by using bolt 409. Optionally, bolts 408 can be used to maintain first inner pipe end 411 and inside outer pipe 402 under tension. As the golf bag insert 400 is generally not used in horizontal position (and is generally used in a substantial vertically orientation or is an orientation having a significant vertical component), gravity will also work to maintain the first inner pipe end 411 and inside outer pipe 402 under tension. As shown in FIG. 4, bolts 408 and 409 can be a nut and bolt arrangement. Other types of fasteners known in the art can alternatively be used (such as spring loaded tabs).

Optionally, outer pipe 402 has an outer pipe cap 406 (such as a rubber cap) positioned at second outer pipe end 407. This provides safety features to protect both the user and golf bag.

A hook 409 is attached to the outer pipe 402 near second outer pipe end 407. Connector 409 (such as an adjustable hook) can be used for further securing the golf bag insert to the golf cart bag attachment of the golf cart. Other connectors known in the art can be used.

In alternative embodiments of the present invention, the orientation of the inner pipe 401 and outer pipe 402, such that the hook 409 attached to the inner pipe 401 near second inner pipe end 403. In such instance, end cap 406 would provides protection such that when the golf bag insert 400 is placed inside a golf bag, it will protect the interior of the bag from tear. It would also provide safety when handling the golf bag insert.

Figure 5:
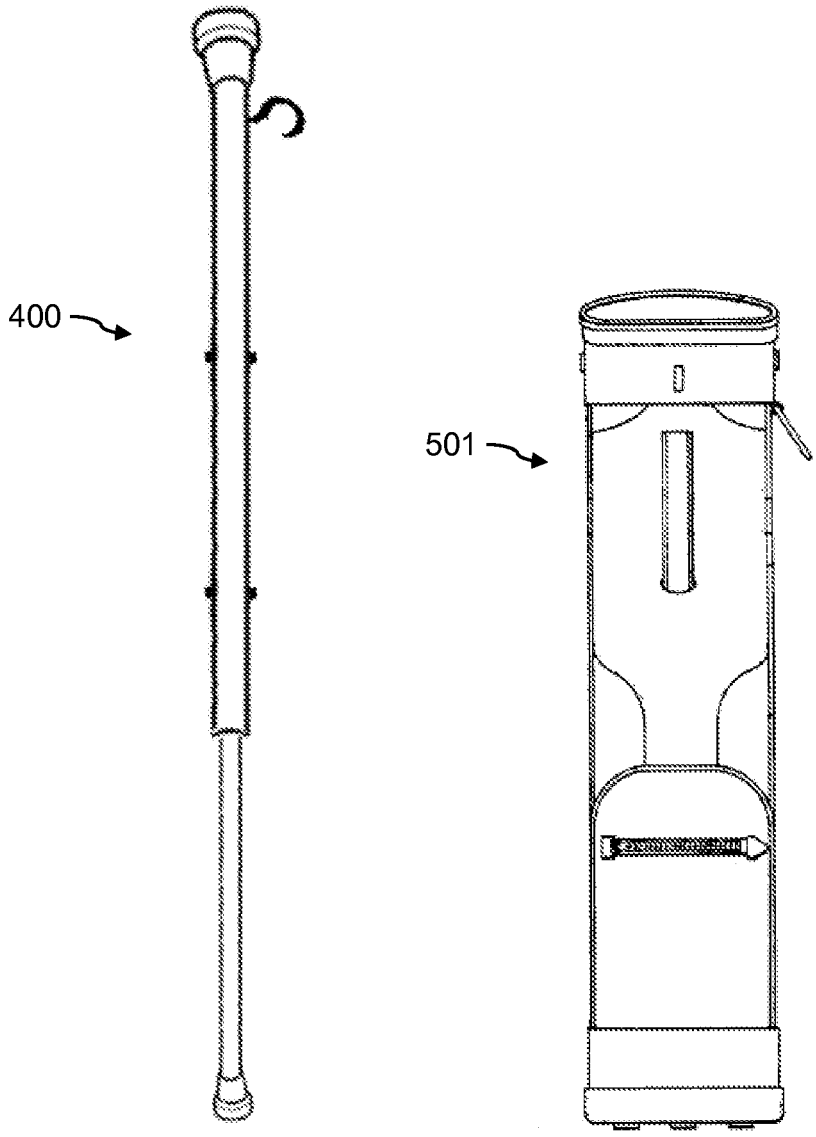
FIG. 5 is an illustration of a golf bag insert device of the present invention before insertion of into the junior golf bag.
Figure 6:
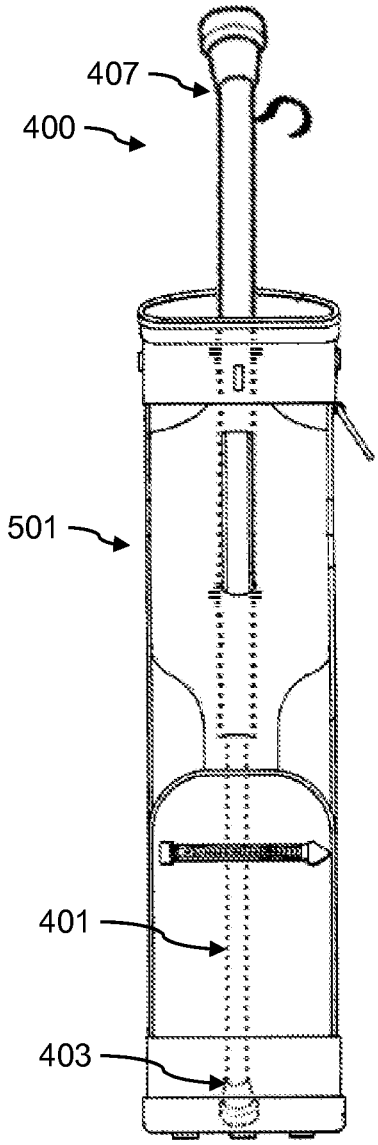
FIG. 6 is an illustration of a golf bag insert device of the present invention after inserting into the junior golf bag.

FIG. 5 shows golf bag insert device 400 and a junior golf bag 501 before insertion. FIG. 6 shows golf bag insert device 400 after inserting it into the junior golf bag 501.

The golf bag insert device 400 is used by inserting the golf bag insert device 400 in a junior golf bag 501 similar to a golf club. The second inner pipe end 403 of first pipe 401 is positioned at the bottom of the junior golf bag, such that the second outer pipe end 407 extends outside the bags, similar to the heads of the golf clubs.

As noted above, in some embodiments of the present invention, the design of the golf bad insert device 400 can be reversed such that the hook 409 is attached to the inner pipe 401 near second inner pipe end 403. In such instance, the second outer pipe end 407 is positioned at the bottom of the junior golf bag, such that the second inner pipe end 403 extends outside the bags, similar to the heads of the golf clubs.

Figure 7:
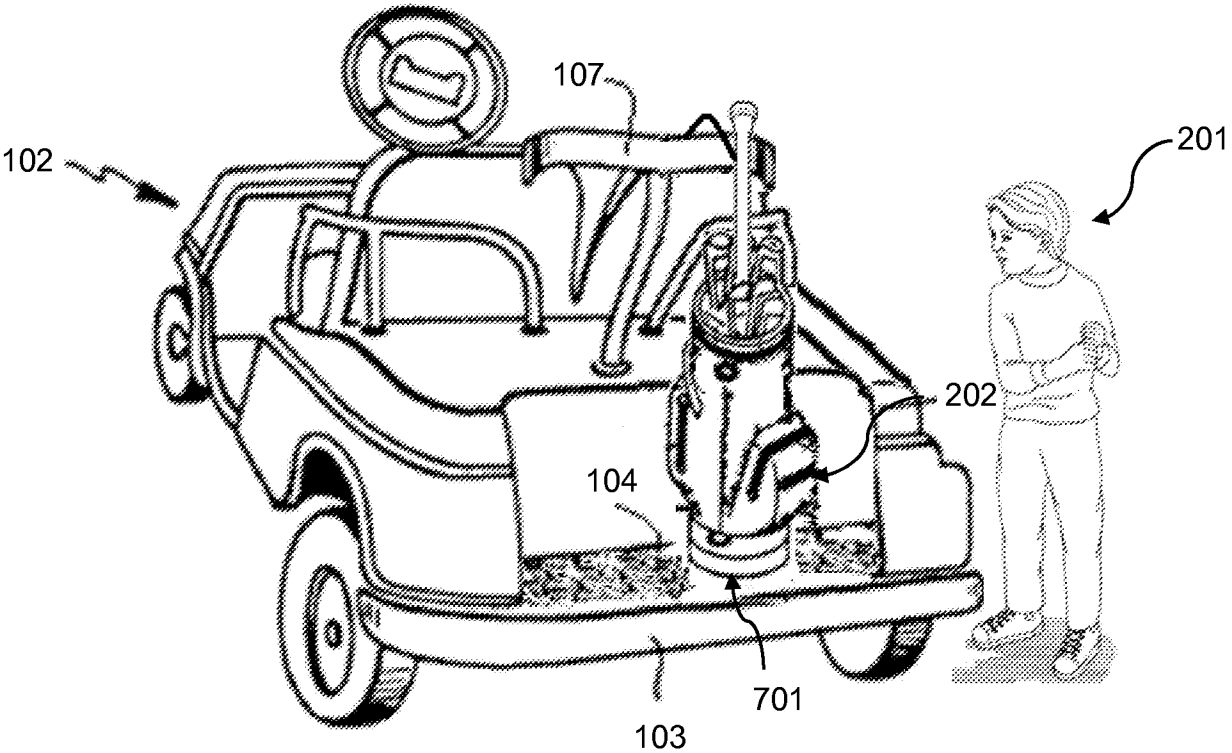
FIG. 7 is an illustration of a junior golfer's bag attached to a golf cart using a golf bag insert device of the present invention.

FIG. 7 illustrates how the golf bag insert device 400 is connected to the golf cart in the resting on the back area 104 of the rear portion 103 of the golf cart 102 designed for holding adult golfer's bag, which are found in most golf carts.

The golf bag insert device 400 sits in the bag like a club. When compressed and attached to the cart with the adjustable hook 409 (such as to golf bag holder 107), golf bag insert device 400 is able to hold the junior golf bag 202 as secure as if they were secured with a traditional strap of the standard attachment designed for adult golfer's bag. Optionally, the strap and buckle used for holding adult golf bags can be used to further secure the golf bag insert device 400 (and junior golf bag 202). The hook 409 may be also (and alternatively) used to attach to other portions of the golf cart, such as a wire basket of the golf cart. While not shown in FIG. 7, golf carts often have wire baskets for holding various things. Golf bag insert device 400 can be attached to such wire baskets using hook 409. In some cases, the wire basket is positioned lower than golf bag holder 107, which allows for the golf bag insert device to maintained at a lower height (while remaining under tension).

As shown in FIG. 7, with the golf bag insert device 400, the junior golf bag 202 clubs sit on the golf cart 102 with the base 701 of the junior golf bag 202 at the same place as an adult golf bag would rest. This allows the top of the bag to be at a height that allows the junior to reach his or her clubs avoiding the need for assistance.

Figure 3:
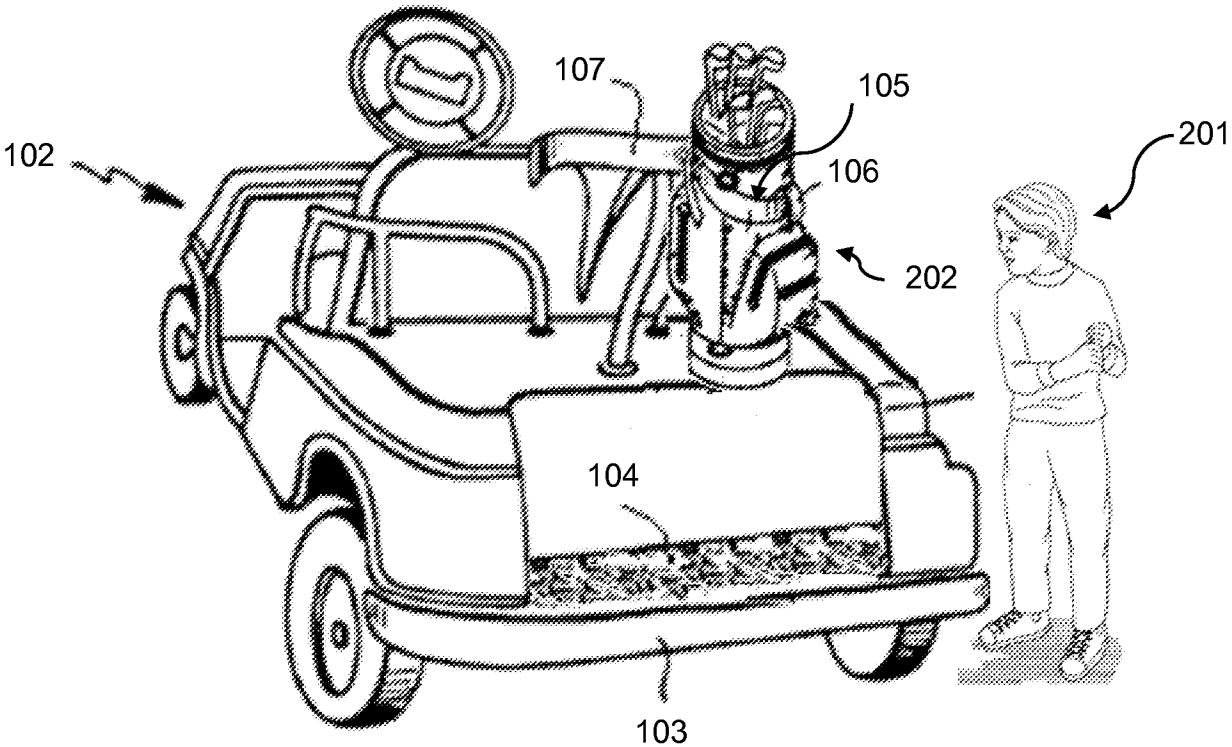
FIG. 3 is an illustration of a junior golfer's bag attached to a golf cart using a standard attachment designed for an adult golfer's bag, which shows problems that a junior golfer has in visually viewing clubs, selecting the club, and then physically removing the clubs from the junior golfer's bag.

By use of the golf bag insert device, the junior bag is now at a height that allows the junior golfer to see the clubs for easy selection and also sits low enough for the junior golfer to select the club and remove it for use without assistance. This will also allow the junior golfer to replace the club back in bag without assistance. Moreover, because the junior golf bag is now resting on the golf cart (and not hanging in the air, as shown in FIG. 3), the bag is more securely held in place on the golf cart.

Figure 8:
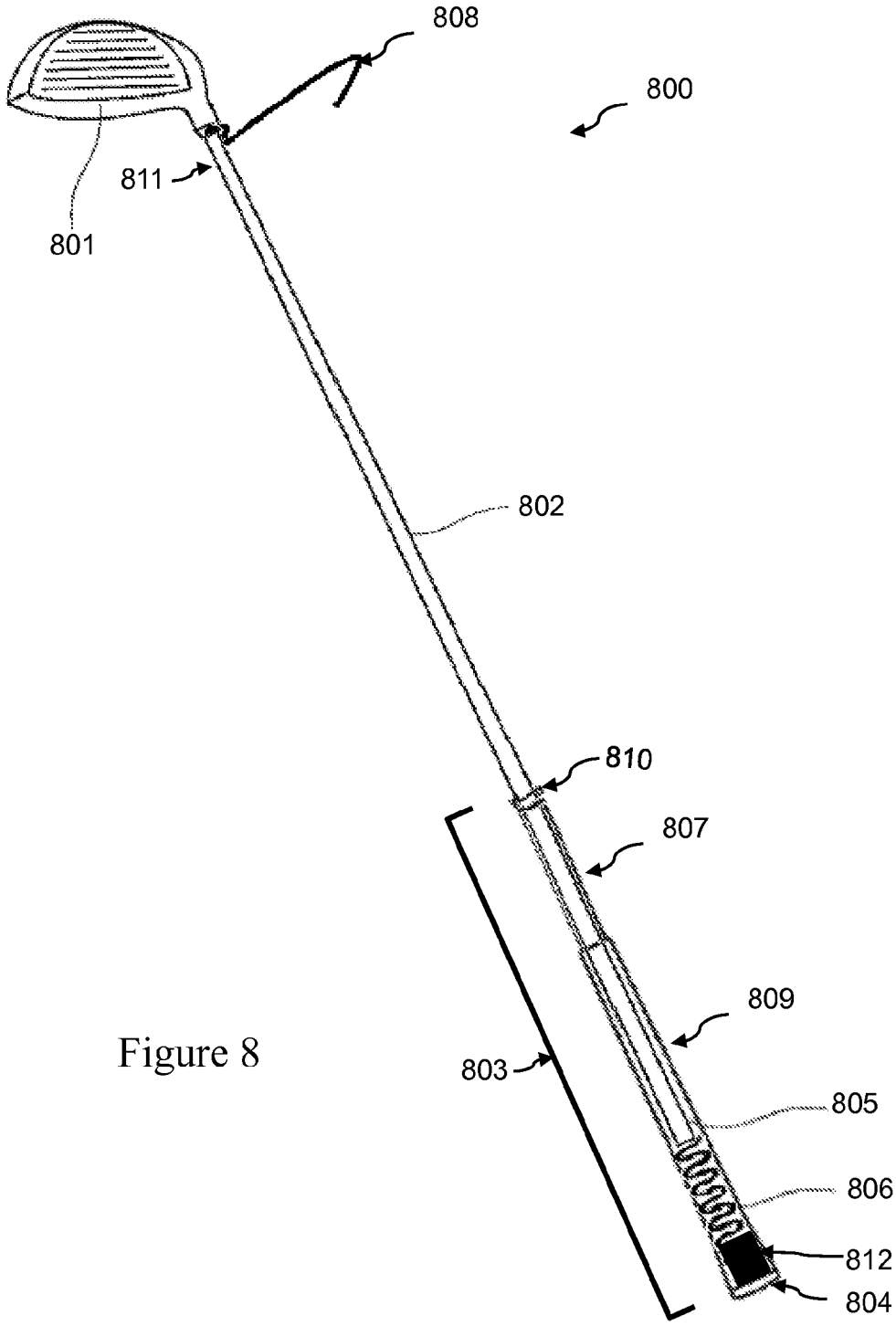
FIG. 8 is an illustration of an alternative golf bag insert device of the present invention.

FIG. 8 is an illustration of an alternative golf bag insert device of the present invention. The golf bag insert device 800 is designed to look like a golf club by using a golf head 801 at one end of the golf insert device 800. As shown in FIG. 8, golf head 801 is shaped like a wood head. However, an iron head can optionally be utilized.

Golf head 801 is attached to a first pipe 802 that can be designed to look like the shaft of a golf club. This includes a first pipe 802 that is tapered in a standard design of a standard golf club shaft. In embodiments of the present invention, the first pipe 802 is a shaft of a golf club. The material can be metal, wood, plastic, PVC, etc. First pipe 802 is designed to fit within second pipe 803, which can be designed to look like the grip portion of a golf club.

In some embodiments of the present invention, the second pipe includes the grip portion 809 of a golf club that can now accept the second pipe 803 within it. The outer material of second pipe 803 in the grip portion 809 can be the same material used in golf grips. Like the end of a golf grip of a golf club, second pipe 803 has an end 804 that is designed to rest at the base of the golf bag similar to the manner in which standard clubs rest.

As shown in FIG. 8, the second pipe 803 optionally can further include a portion 807 that is made of the same material as first pipe 802. Portion 807 can be tapered like a shaft of a golf club. Due to the tapering of the first pipe 802 and the second pipe 803, the end portion 810 of the second pipe 803 can be designed to have an inner diameter that is less than the outer diameter of end 805 of first pipe 802. By this arrangement, while first pipe 802 can slide within second pipe 803, first pipe 802 and second pipe 803 are physically prevented from sliding apart from one another.

As further shown in FIG. 8, end 805 of first pipe is within second pipe 803. A spring 806 is positioned inside second pipe to maintain first pipe 802 and the second pipe 803 tension. Optionally, a block 812 or other structure can be placed within the second pipe 804 between spring 806 and end 804 for support. The block can also be attached to the spring 806 and/or the end 804 to secure the block and/or spring 806 within second pipe 804.

Golf bag insert device 800 is designed to rest in a golf bag in the same orientation as a golf club. Accordingly, golf bag insert device 800 will generally be used to positioned in the golf bag with second end 803 (the grip end) inside and at the base of the golf bag and golf head 801 outside and at the top of the golf bag. For this reason, the hook 808 will generally be located at or near the end of the first pipe 802 to which golf head 801 is attached. Moreover, by this orientation, gravity will generally keep the spring 806 under tension is such orientation. Thus, once the hook 808 is attached to a portion of the golf cart (such as a wire basket), the spring 806 will provide tension. In such manner, the golf bag insert device 800 is secured within the golf bag and the golf bag is secured to the golf cart.

As discussed above, the inner diameter of second pipe 803 at end 810 is less than the outer diameter of first pipe 802 at end 805, which prevents them from sliding apart from one another. Optionally, tabs or nuts and bolts (such as shown in FIG. 4) can be used to set and maintain the first pipe 802 and second pipe 803 in position (so as to maintain the golf bag insert device at a preferred length desired). Optionally, portion 807 of the second pipe 803 can be designed such that it can be tighten when rotated (a rotatable tightener) to apply friction to the first pipe 802 to further secure the first pope 802 with the second pipe 803.

The embodiment shown in FIG. 8 can be constructed as follows. A golf club having a removable head is selected. The shaft of the golf club is then cut somewhere between the grip and the head, yielding a first portion of the golf club that includes a portion of the shaft and the golf head (which is coincides with the first pipe 802 shown in FIG. 8) and a second portion of the golf club that includes a portion of the shaft and the golf grip (which is coincides with the second pipe 803 shown in FIG. 8). Generally, the shaft is cut closer to the golf grip than the golf head.

For ease of description, these sections will be further described referring to the configuration shown in FIG. 8. The golf head (such as golf head 801) can be removed from the first pipe 802 (i.e., the first portion of the golf club that includes a portion of the shaft and the golf head 801) at end 811. At end 804 of second pipe 803 (the second portion of the golf club that includes a portion of the shaft and the golf grip), an end cap is removed such that the first pipe 802 (without golf head 801) can be threaded through second pipe 803. Beginning at end 811 of the first pipe 802, first pipe 802 (without golf head 801) is threaded into second pipe 803 at end 804. Once end 805 is positioned inside second pipe 803, spring 806 is then inserted. Furthermore, if desired, block 812 is then inserted. Spring 806 and/or block 812 can be secured, and the end cap can be returned to end 805. Hook 808 can then be positioned at end 811 and golf head 801 can be reattached to the first pipe 802.

Optionally, this process can further include further cutting of the golf shaft to further shorten the length of the golf bag insert device 800.

Another advantage of the present invention is that it can be shorten to a length that allows the golf bag insert device to be stored within the junior golf club bag in a manner similar to the junior golf clubs are stored. Accordingly, the golf bag insert device can be kept in the junior golf bag until needed for use, at which time the golf bag insert device is expanded to the desired length. Once the golf bag insert device is no longer needed (i.e., the junior golf bag is to be disconnected from the golf cart), the golf bag insert device can then be shorted to a length that allows it to be maintained in the junior golf bag like a junior golf club (i.e., the golf bag insert device can be stored within the golf bag). This facilitates the transfer of the golf bag insert device, renders it available for use when the need arises, and reduces (or eliminates) the possibility of forgetting the golf bag insert device when bringing the junior golf clubs to play golf.

Tilted Golf Bag Securing Device

Figure 9:
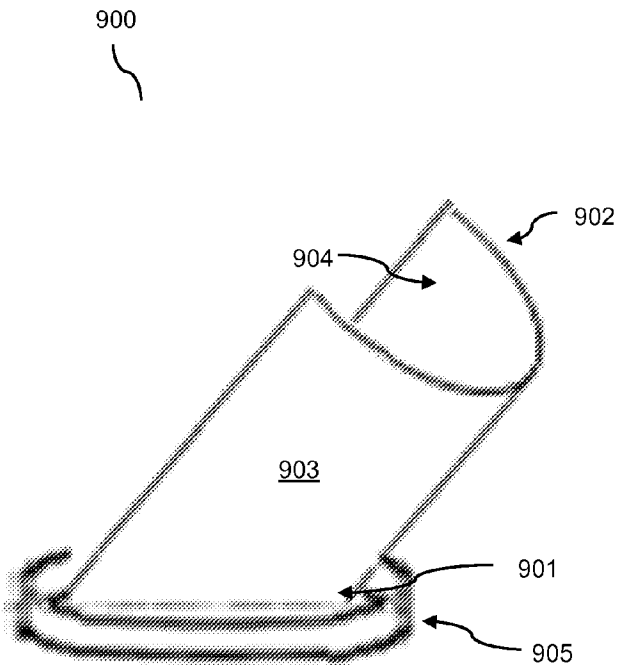
FIG. 9 is an illustration of a tilted golf bag securing device of the present invention.

FIG. 9 is an illustration of a tilted golf bag securing device 900 that can be used to secure a junior golfer's bag to a golf cart using the standard attachment designed for an adult golfer's bag. As standard attachment designed for an adult golfer's bag are used on most present day golf carts, the tilted golf bag securing device 700 can be readily used with most golf carts.

Figure 1:
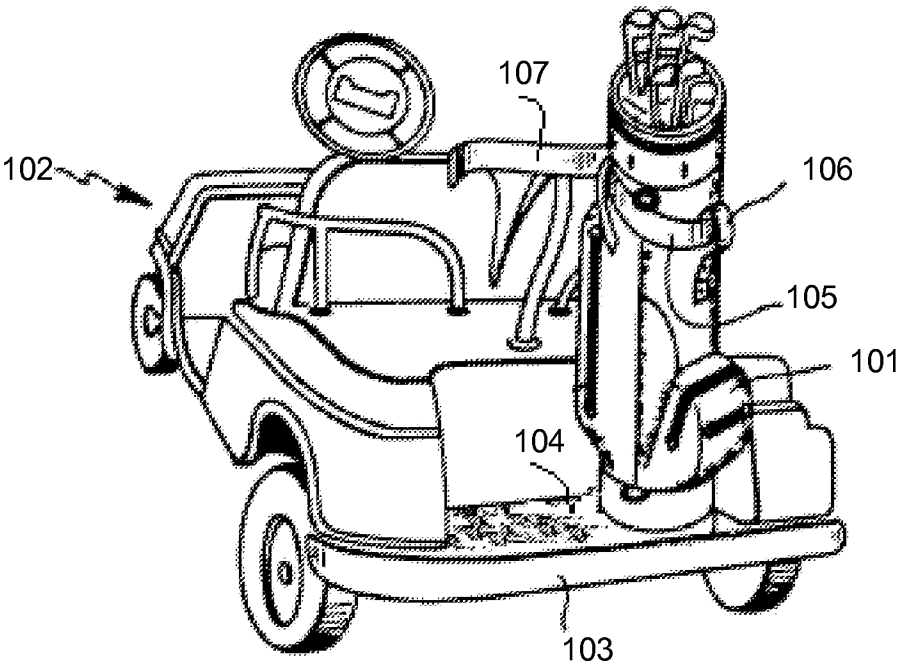
FIG. 1 is an illustration of adult golfer's bag attached to a golf cart using a standard attachments designed for adult golfer's bag.
Figure 2:
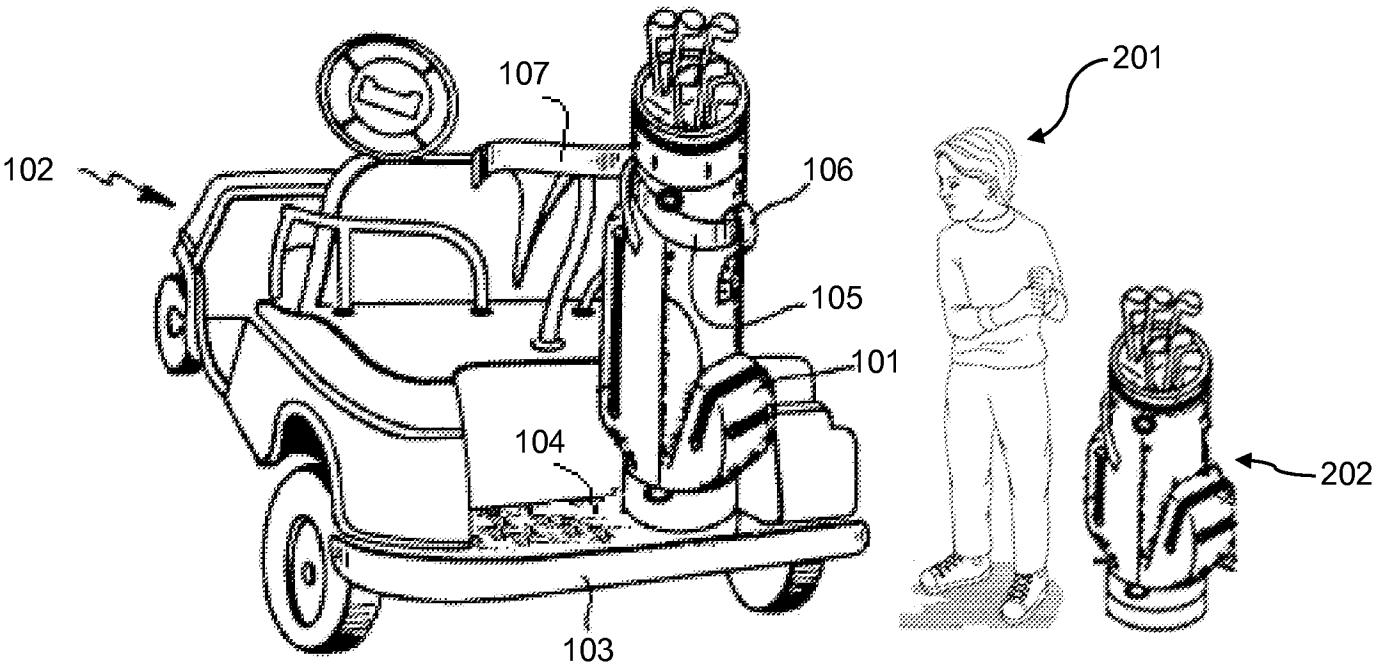
FIG. 2 is an illustration reflecting issues associated with junior golfers and junior golf bags and standard golf carts.

When an adult golfer's bag is secured to a golf cart using a standard attachment designed for an adult golfer's bag, the adult bag stands vertically. When so secured, the bottom of the adult bag rests in a section at the back of the cart, which shall referred to herein as the "golf bag receptacle." Such receptacle is in the back area of the golf cart that can be seen in earlier figures, such a back area 104 located at the rear end 103 of golf cart 102 shown in FIG. 1. The tilted golf bag securing device 900 is designed to be placed into the golf bag receptacle and allows for a junior golfer's bag to be secured at an angle.

As shown in FIG. 900, the tilted golf bag securing device is formed in a curved material having a base 901, a top 902, and outer wall surface 903, and an inner wall surface 904 (all of which can be made from metal). Optionally, an extended base 905 attached to base 901 can be used for further positioning the tilted golf bag device in the golf bag receptacle. The curved material is designed to have an opening of the inner wall 904 such that a golfer's bag can rest on the inner wall surface 904. Moreover, the curvature is such that when a golf bag rests on the inner wall surface 904, the inner wall surface 904 surrounds a portion of the back and sides of a bottom section of the golf bag. This will allow for support of the bag as the golf cart moves.

Figure 10:
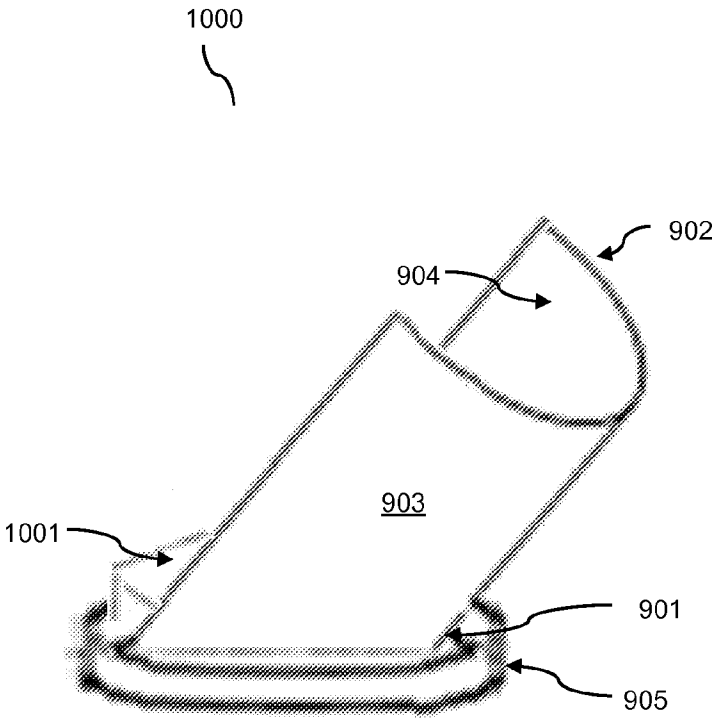
FIG. 10 is an illustration of an alternative tilted golf bag securing device of the present invention.

FIG. 10 is an illustration of a tilted golf bag securing device 1000 in which an extended base 905 has an angled top 1001 upon which the base of a golf bag would rest when the golf bag is resting on the inner wall surface 904. By this angled top, a greater portion of the base of golf bag is in contact with extended base 905.

Figure 11:
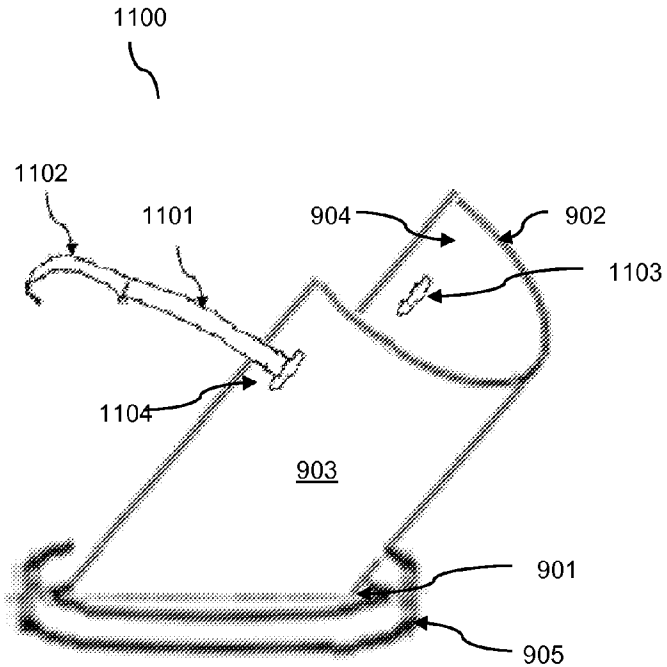
FIG. 11 is an illustration of a second alternative tilted golf bag securing device of the present invention.

FIG. 11 is an illustration of a tilted golf bag securing device 1100 that has a strap 1101 can then be used to secure the golf bag in place. Strap 1101 (connect at hole 1104) can be secured with a fastener 1102 (such as a hook, hook and look material, snap, or other 1101 can be secured on the other side of the fasteners known in the art). The strap can be secured by threading it through hole 1103 after the golf bag is in resting on inner wall surface 904. Optionally, the strap can be thread through the handle or other portion of the golf bag. Alternatively, the strap can be pulled completely around the circumference of the tilted golf bag securing device 1100 and then fastened like a belt.

It should be noted that a strap 1101 can be used to connect the tilted golf bag securing device 900 and the tilted golf bag securing device 1000 by simply positioning a strap 706 around the base and keeping it in place due to tension.

Figure 12:
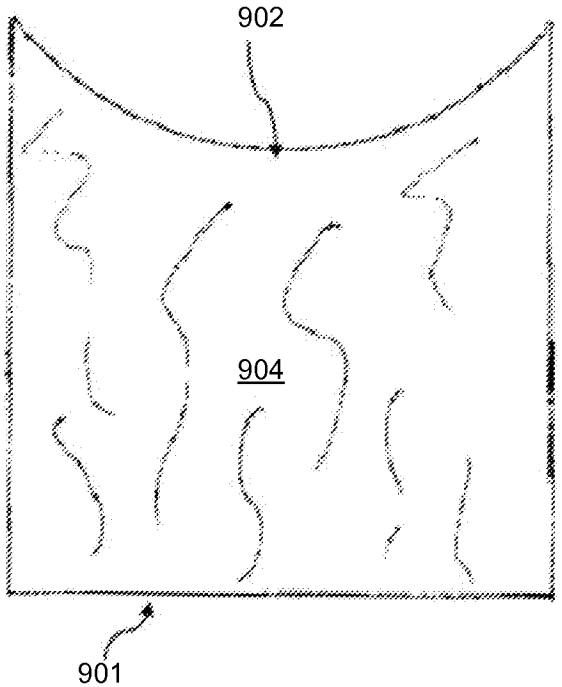
FIG. 12 is a front view illustration of a tilted golf bag securing device of the present invention.
Figure 13:
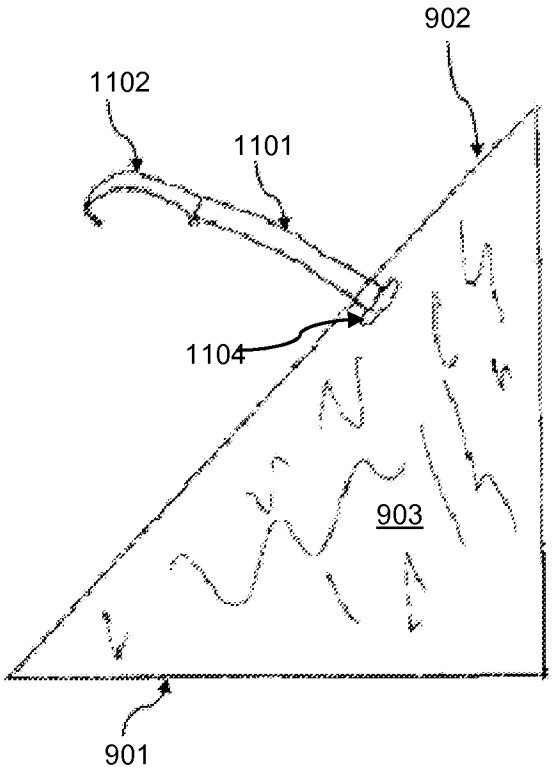
FIG. 13 is a side view illustration of a tilted golf bag securing device of the present invention.

FIG. 12 is a front view illustration of the golf bag securing device (without the base 905 and strap 1101), such as golf bag securing device 900, when viewed from the side upon which the golf bag would rest. FIG. 13 is a side view illustration of the golf bag securing device (without the base 905 but with strap 1101), such as golf bag securing device 1100.

Figure 14:
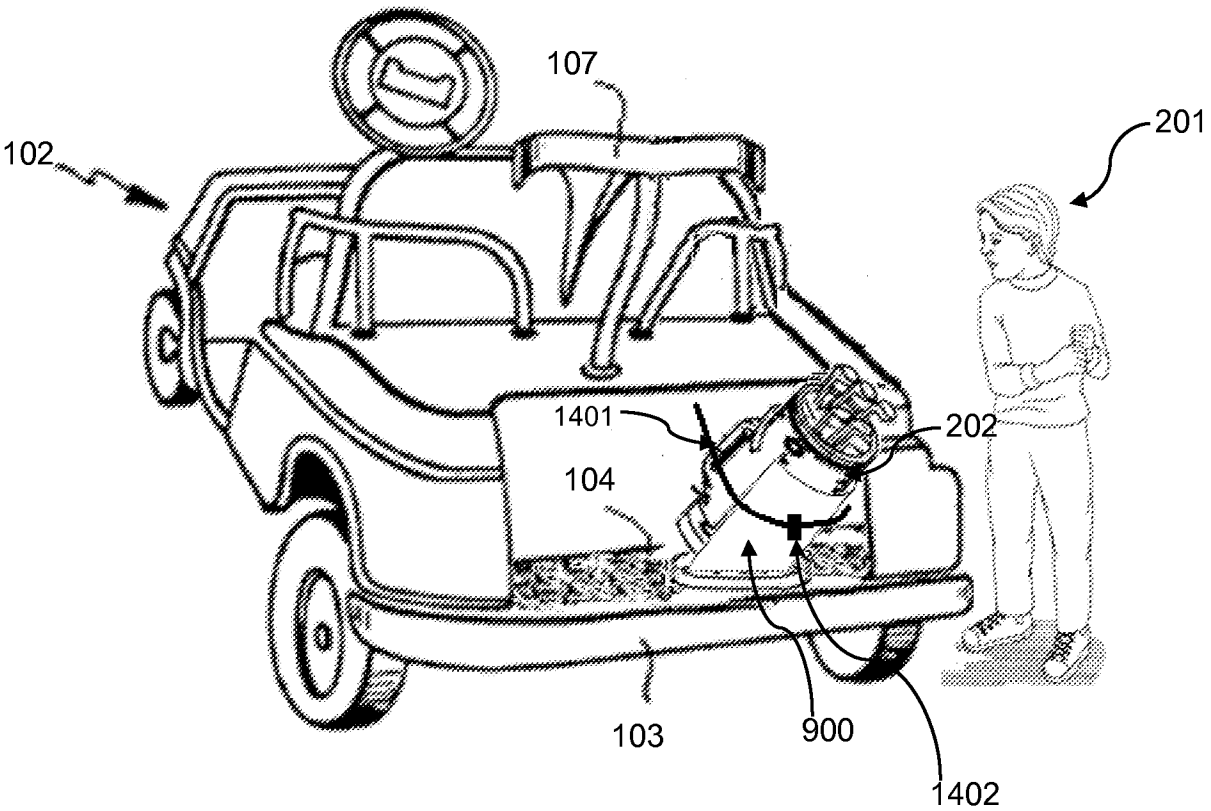
FIG. 14 is an illustration of a tilted golf bag securing device of the present invention attached to a standard attachment designed for an adult golfer's bag (with the junior golf bag shown).

FIG. 14 is an illustration of the tilted golf bag securing device 900 of FIG. 9 attached to a standard attachment designed for an adult golfer's bag (with the junior golf bag 202 shown). The tilted golf bag securing device 900 is placed in the golf bag receptacle in back area 104 located at the rear end 103 of golf cart 102. A golf bag (such as junior golf bag 202) can then be placed in the tilted golf bag securing device 900 (which from the orientation of FIG. 13 would be from left upper to right lower). A strap 1401 can then be used to secure the tilted golf bag securing device 900 and junior golf bag 202 in place. (Strap 1401 is not shown in FIGS. 9-13). Strap 1401 can be secured with a fastener (such as a hook, hook and loop material, belt fasteners, snaps, or other fasteners known in the art). These can be connected to the golf cart 102 at golf bag holder 107 or other structures located at or near the rear end 103 of the golf cart 102. For example, and while not shown in FIG. 14, golf carts often have wire baskets for holding various things; strap 1401 can be attached to such wire baskets using a hook. While FIG. 14 shows the strap 1401 connected to the tilted golf bag securing device 900 at connector 1402, strap 1401 can used by simply positioning strap 1401 around the tilted golf bag securing device 900 and keeping it in place due to tension. Moreover, connector 1402 can further include means by which the strap 1401 is maintained in tension.

The tilted golf bag securing device of the present invention provides a junior golfer better viewing and convenient access to the clubs. The tilted golf bag securing device holds the golf bag at an angle allowing for better viewing and also giving even the smallest of junior golfers the ability to select and retrieve the club of their choice by themselves. The tilted golf bag securing device is a device that sits in the cart where the full sized bag sits but is angled to allow the junior bag to lay at an angle verses the traditional straight up and down. The use of straps to secure the tilted golf bag securing device to the golf cart and to hold the junior bag in place secures the bag over even the roughest terrain.

With tilted golf bag securing device, juniors of all sizes as well (as adult golfers that would like their clubs at a more accessible angle), can have the ease of club selection and access.

While embodiments of the invention have been shown and described, modifications thereof can be made by one skilled in the art without departing from the spirit and teachings of the invention. The embodiments described and the examples provided herein are exemplary only, and are not intended to be limiting. Many variations and modifications of the invention disclosed herein are possible and are within the scope of the invention. Accordingly, other embodiments are within the scope of the following claims. The scope of protection is not limited by the description set out above, but is only limited by the claims which follow, that scope including all equivalents of the subject matter of the claims.

The disclosures of all patents, patent applications, and publications cited herein are hereby incorporated herein by reference in their entirety, to the extent that they provide exemplary, procedural, or other details supplementary to those set forth herein.

What is claimed is:

1. A golf bag insert device comprising:

(a) an inner pipe, wherein the inner pipe has a first inner pipe end and a second inner pipe end;

(b) an outer pipe slidably connected to the inner pipe, wherein (i) the outer pipe has a first outer pipe end and a second outer pipe end;

(ii) the first inner pipe end is positioned within the first outer pipe end;

(iii) the second inner pipe end is at a first end of the golf bag insert device;

(iv) the second outer pipe end is at a second end of the golf bag insert device; and (v) the inner pipe is operable to slide within the outer pipe such that the golf bag insert device has a length that is variable;

(c) a spring locating within the outer pipe operably in contact with the first end of the inner pipe, wherein the spring is operable for maintaining tension between the outer pipe and the inner pipe;

(d) a connector; and (e) a first pipe cap, wherein (i) one of the connector and the first pipe cap is connected at or near the first end of the golf bag insert device, (ii) an other of the connector and the first pipe cap is connected at or near the second end of the golf bag insert device, (iii) the first pipe cap is operable for insertion into a golf bag having a base and resting at the base of the golf bag without substantial damage to the golf bag;

(iv) the length of the golf bag insert device is operably variable to maintain the connector outside the golf bag when the first pipe cap is resting at the base of the golf bag while the spring maintains tension between the outer pipe and the inner pipe;

(v) the golf bag is a junior golf bag; and (vi) the connector is operably connectable to a portion of a golf cart to secure the junior golf bag to the golf cart at a level wherein a junior golfer can view golf clubs within the junior golf bag, remove clubs from the junior golf bag, and place clubs into the junior golf bag.

2. The golf bag insert device of claim 1, wherein one or both of the outer pipe and inner pipe comprises metal.

3. The golf bag insert device of claim 1 further comprising a fastener located on one or both of the outer pipe and the inner pipe operable for fastening the outer pipe and inner pipe together while tension is applied by the spring.

4. The golf bag insert device of claim 3, wherein the fastener is selected from the group consisting of a nut and bolts, tabs, rotatable tighteners, and combinations thereof.

5. The golf bag insert device of claim 4, wherein the fastener comprises a spring loaded tab.

6. The golf bag insert device of claim 1, wherein the connector comprises a hook.

7. The golf bag insert device of claim 1, wherein the golf bag insert device is in the form of a golf club.

8. The golf bag insert device of claim 1 further comprising a second end cap, wherein the second end cap is connected at the end of the golf club insert near the connector.

9. The golf bag insert device of claim 8, wherein the second end cap is in the shape of a golf club head.

10. The golf bag insert device of claim 8, wherein the second end cap comprises a golf club head.

11. The golf bag insert device of claim 1, wherein:

(a) the inner pipe is in the form of a golf club shaft;

(b) the outer pipe comprises a first portion that is in the form of a golf club grip;

(c) the spring is located within the first portion of the outer pipe;

(d) the connector is connected near the second inner pipe end;

(e) a second end cap is connected at the second inner pipe end;

the second end cap is in the form of a golf club head; and (g) the golf club insert device is in the form of a golf club.

12. The golf bag insert device of claim 1, wherein:

(a) the inner pipe is a portion of a golf club shaft, wherein a golf club head is attached to the inner pipe;

(b) the outer pipe is a portion of a golf club shaft that includes the golf club grip;

(c) the spring is located within the golf club grip; and (d) the connector is connected near the golf club head.

13. The golf bag insert device of claim 1, wherein (a) the golf bag insert device is operable for moving the inner pipe and the outer pipe end relative to one another and maintaining the golf bag insert device at variable lengths; and (b) the golf bag insert device is operable for being maintained at a length short enough to be stored within the junior golf club bag in the same manner as junior golf clubs are stored within the junior golf club bag.

* * * * *